United States Patent [19]

Thater

[11] Patent Number: 4,831,956

[45] Date of Patent: May 23, 1989

[54] TENNIS SCORING APPARATUS

[76] Inventor: Richard D. Thater, 70-31 108 St., Forest Hills, N.Y. 11375

[21] Appl. No.: 214,088

[22] Filed: Jul. 1, 1988

[51] Int. Cl.[4] ..... G08B 5/00

[52] U.S. Cl. ..... 116/222; 116/325; 273/DIG. 26; 40/489; 40/604

[58] Field of Search ..... 116/222–225, 116/306, 307, 325, 326, DIG. 3; 235/90; 273/DIG. 26, DIG. 30, 29 R, 277, 285, 286; 40/489, 490, 534, 604, 618, 124.2

[56] References Cited

U.S. PATENT DOCUMENTS

| | | | |
|---|---|---|---|
| 1,678,621 | 7/1928 | Holmes | 40/490 |
| 1,705,581 | 3/1929 | Marco et al. | 116/222 |
| 3,716,016 | 2/1973 | Aylesworth et al. | 116/222 |
| 3,922,805 | 12/1975 | Krug | 116/223 |

FOREIGN PATENT DOCUMENTS

| | | | |
|---|---|---|---|
| 525532 | 8/1940 | United Kingdom | 116/222 |

*Primary Examiner*—William A. Cuchlinski, Jr.
*Assistant Examiner*—W. Morris Worth
*Attorney, Agent, or Firm*—Pennie & Edmonds

[57] ABSTRACT

This invention relates to a portable, yet full size tennis scoring apparatus. This scoring device is constructed of a durable fabric and is designed so as to be foldable about itself into a small and portable configuration and yet be unfoldable to a full size with adequate room for indicating players' names, set, game and point scoring tallies and promotional, organizational or sponsorship information. This tennis scoring apparatus is also designed so as to be large enough so that when it is unfolded it would be clearly visible to the players and spectators. Further, the apparatus is designed so it is capable of being affixed during use to either fence netting or netting post. This device also enables a player to accurately measure the height of the net at the center. Paddle-shaped markers are removably held in pockets formed on the fabric and register with scoring indicia placed on scoring placards which are also detachably held on the fabric.

21 Claims, 10 Drawing Sheets

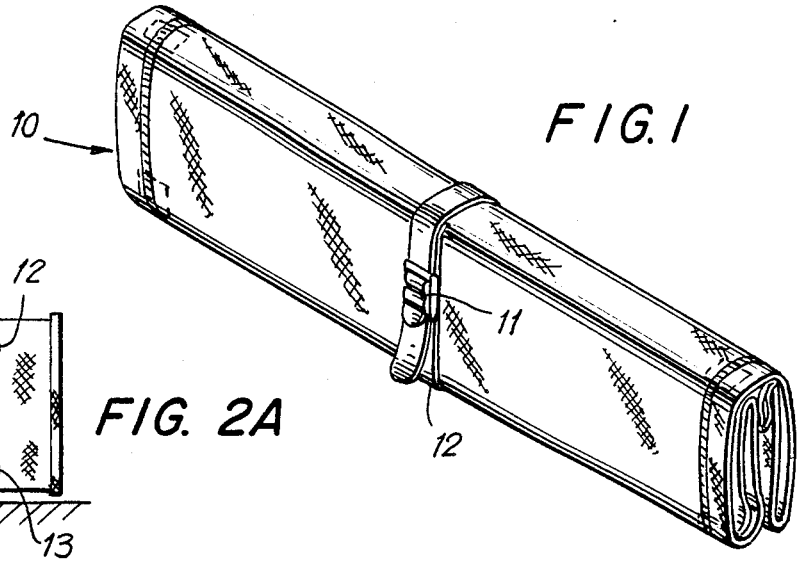
FIG. 1
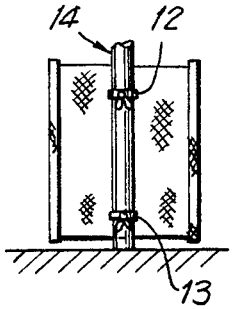
FIG. 2A
FIG. 2
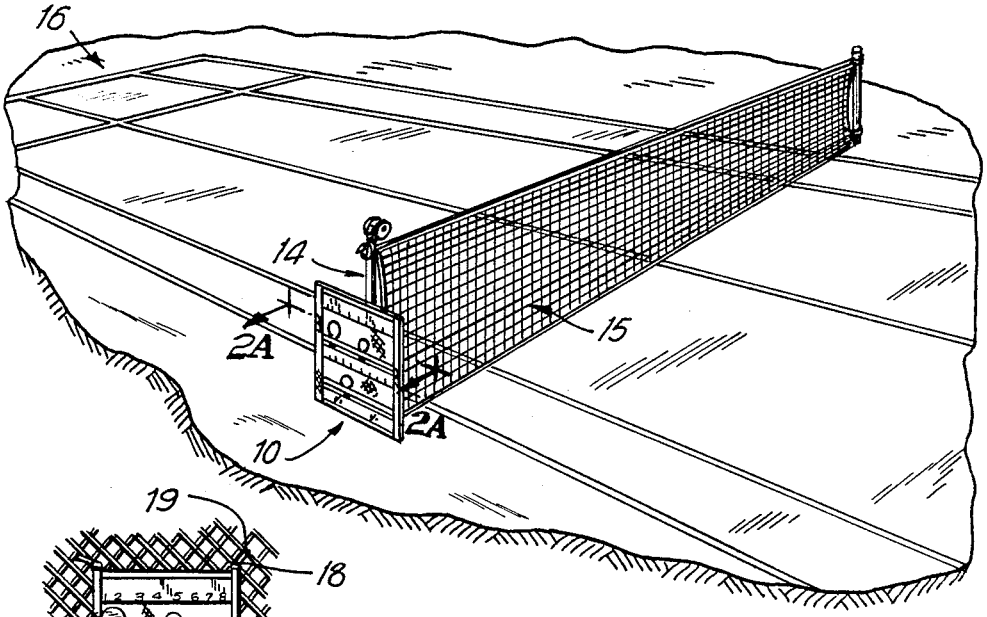
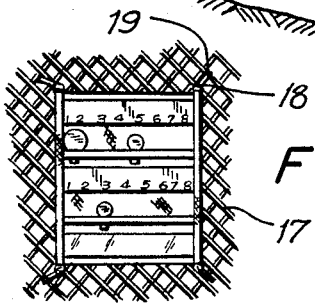
FIG. 3

FIG. 4
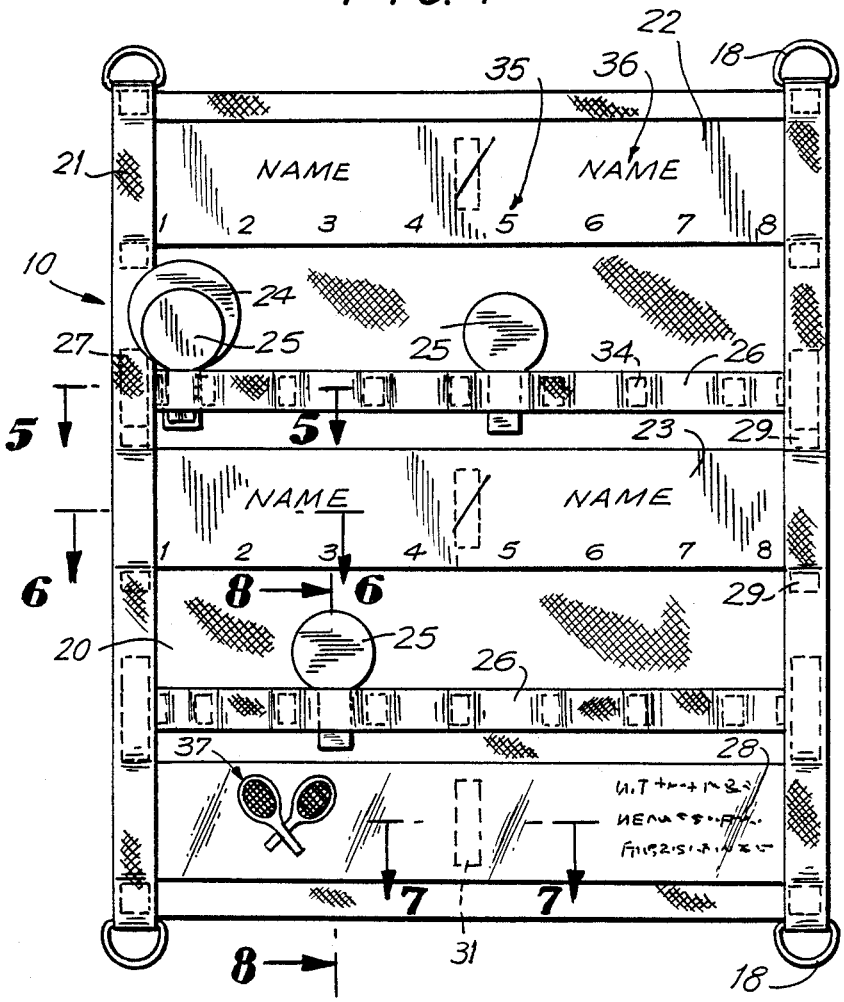
FIG. 5
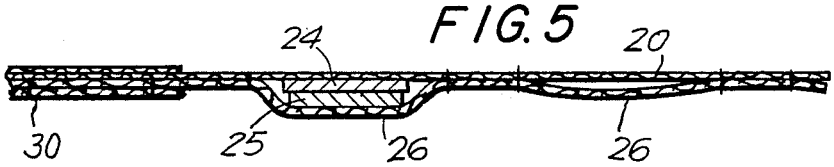
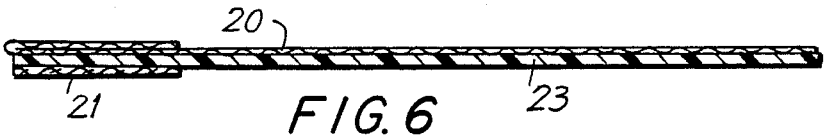
FIG. 6

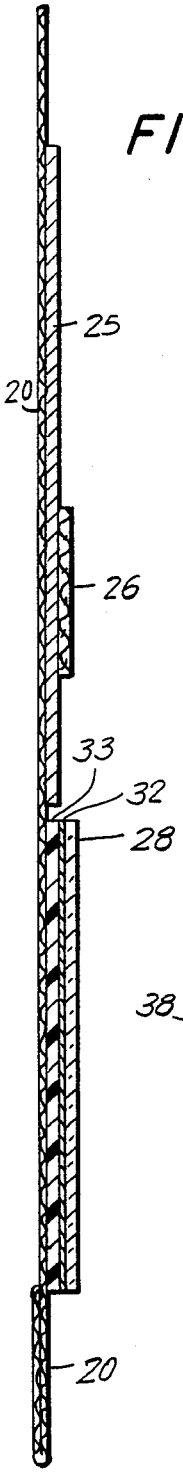
FIG. 8
FIG. 7
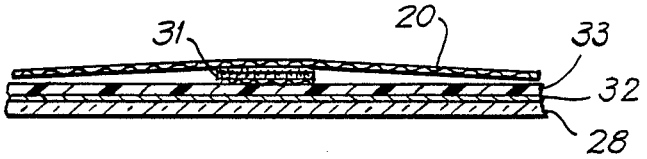
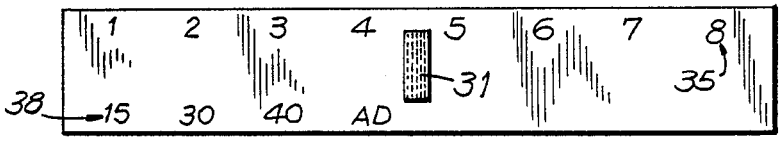
FIG. 9

TENNIS SCORING APPARATUS

FIELD OF THE INVENTION

This invention relates to a tennis scoring apparatus. More specifically, this invention relates to a tennis scoring device which is both foldable to a portable configuration and unfoldable to a full size.

BACKGROUND OF THE INVENTION

A variety of scoring devices have been devised for use in maintaining a record of the game points, game and/or set score in a tennis match.

These scoring apparatus have included small hand held devices such as that disclosed, in U.S. Pat. No. 4,132,187 to Moebius; U.S. Pat. No. 4,357,895 to Nightingale and U.S. Pat. No. 4,189,143 to Van Auken et al. Tennis scoring devices have also been incorporated into articles of apparel such as a wristband disclosed in U.S. Pat. Nos. 4,164,910 to Feiler; 4,158,342 to Scruggs and 4,557,215 to Petersson. Tennis scoring devices have also been incorporated into items such as a wrist watch as in U.S Pat. No. 4,331,098 and Swiss Pat. No. 607,749 issued Oct. 31, 1978.

Tennis scoring devices have been incorporated into tennis racquets themselves as in U.S. Pat. No. 4,331,098 to Rubano; European Patent Application No. 024552 published July 24, 1980, U.S. Pat. No. 4,189,143 to Van Auken et al.; U.S. Pat. No. 4,202,544 to Popma; U.S. Pat. No. 4,498,668 to Bowen and French Pat. No. 2,460,689 filed Mar. 30, 1979. Electronic tennis score keepers have also ben developed such those disclosed in U.S. Pat. No. 4,237,372 to Zev Golis et al. and U.S. Pat. No. 4,491,954 to Genuit.

More traditional tennis score keeping banners on which various players names are placed onto the banner and the tennis score is recorded by numbers which are either flipped over or marked on the tennis score keeper is shown is U.S. Pat. No. 3,220,127 to Wilson. This apparatus is typically attached to or integral with a netting post and projects vertically upward in the form of a "T". Additional traditional scoring banners are shown in U.S. Pat. No. 3,515,092 to Stengel and Design Pat. No. 27626222 to Eliot.

The art, however, does not include a full size, yet conveniently portable tennis scoring apparatus which has both the advantages of the articles of apparel and hand-held devices in terms of convenience and the visibility and professional appearance of the more traditional and typically fixed standard tennis scoring devices.

It is, therefore, an object of the present invention to provide a fully visible and full size yet portable tennis scoring apparatus.

An additional object of this invention is to provide a tennis scoring apparatus which is easy to use and maintain the score of a tennis match.

A further object of this invention is to provide a tennis scoring apparatus which is easy to affix to a tennis netting post as with traditional tennis scoring devices or, alternatively, to affix to fences which often times surround tennis courts or to affix to the netting itself, positioned between the sideline boundary of the playing surface and the netting post.

It is another object of this invention to provide a full size tennis scoring device which is foldable about itself into a portable configuration.

A further object of this invention is to provide a device to measure the exact height of the net in the center of the court. It is also an object of this invention to provide a tennis scoring apparatus which has additional space for promotional and/or sponsorship and/or other information. These objects and advantages will be described below in greater detail.

SUMMARY OF THE INVENTION

Generally stated, this invention relates to a tennis scoring apparatus which is full sized yet portable. This tennis scoring apparatus is constructed of a durable fabric, such as nylon which allows it to be folded and unfolded, subjected to a variety of environmental conditions and constant handling. In the operation of this device, three scoring markers may be utilized in conjunction with scoring indicia which have been marked on placards which comprise a portion of the device.

More specifically, in the operation of this device, it is preferred that there are three tennis scoring markers: a large white marker having a paddle type shape, a smaller yellow colored paddle marker and a red paddle color marker preferably the size of the yellow colored marker. Two of each marker is present with this apparatus so they may be used in conjunction with the two tennis scoring placards (preferably composed of a hard plastic such as Lucite TM) utilized on the apparatus. The tennis scoring apparatus may be affixed to a tennis netting post, the netting itself, a fence or placed flat on the ground.

With the use of this apparatus, a respective player's game score and set score is recorded. The apparatus indicates the number of games and sets the player (or players if it is a doubles game) has won, directly under the placard with the player's name by placing the scoring marker in a pocket formed on the apparatus directly under game score or set indicia. The smaller marker is used to indicate games won while the larger marker is used to indicate the number of sets which the player has won. The set and game markers are inserted into pockets formed by a material running across the apparatus fabric so as to form a pocket. This material is also affixed to the tennis scoring apparatus along the left and right border of said tennis scoring apparatus. It should also be noted that the name and scoring indicia placards may be reversed so as to be utilized to indicate points scored in individual games in addition to indicating games and sets. It is preferred to affix these placards to the tennis scoring apparatus with velcro. The placards may also be slidably removed from the tennis scoring apparatus so as to facilitate writing of the names or providing other additional information onto said placard or so as to invert the placard to provide, for instance, individual game scoring information (i.e., points 15, 30, 40 add). In addition, rings or snap links are provided on said tennis scoring apparatus which enable the tennis scoring apparatus to be affixed in addition to a fence or other support. This scoring device also may be used to measure the height of the net at its center. Two placards placed adjacent to each other lengthwise equals 36 inches, the correct height.

The lowest placard on the apparatus shows material such as promotional, organizational or sponsorship information, thereby providing spectators with information concerning the tennis match (i.e., which high school or college teams are competing or which organization is providing professional sponsorship).

This tennis scoring apparatus is both small (when folded), convenient and portable for the tennis player who typically carries his/her equipment to a tennis match. Therefore, this invention enables a tennis player to always have a full size yet portable scoring apparatus at a tennis match. More details of this tennis scoring apparatus will become apparent with the following detailed description of this invention.

BRIEF DESCRIPTION OF THE FIGURES

FIG. 1 shows the tennis scoring apparatus in its folded configuration held together by a strap;

FIG. 2 shows the portable and tennis scoring apparatus affixed by lashing it to a net post on a tennis court; 2*a* shows a reverse view of the means by which the tennis scoring apparatus is affixed by lashing it to the tennis netting post;

FIG. 3 illustrates the tennis scoring apparatus affixed by lashing it to a fence;

FIG. 4 shows a front perspective view of the tennis scoring apparatus including scoring indicia, players names and scoring or indicator markers and means for attachment of said tennis scoring apparatus at its cover to a support structure;

FIG. 5 illustrates a cross-sectional view along line 5—5 of FIG. 4 indicating the relationship of the side border fabric structural support of the tennis scoring apparatus, a pocket holding two tennis scoring or indicator markers and an empty pocket not holding any indicator markers;

FIG. 6 illustrates a cross-sectional view along line 6—6 of FIG. 4 illustrating the relationship of a placard including tennis scoring indicia and players names in relation to the fabric support of the tennis scoring apparatus;

FIG. 7 illustrates a cross-sectional view along line 7—7 of FIG. 4 showing the relationship between a placard holding non-scoring promotional or sponsorship information and the tennis scoring apparatus support fabric along with a velcro (or hook and loop) type of attachment. In addition, this figure illustrates a promotional type of material sandwiched between the surfaces of two placards;

FIG. 8 illustrates a cross-sectional view of the tennis scoring apparatus of FIG. 4 along line 8 showing a tennis scoring or indicator marker in a pocket formed on said tennis scoring apparatus;

FIG. 9 illustrates an optional reverse side of the tennis scoring placard including indicia for games or sets and points;

DETAILED DESCRIPTION OF THE INVENTION

Figure 10:
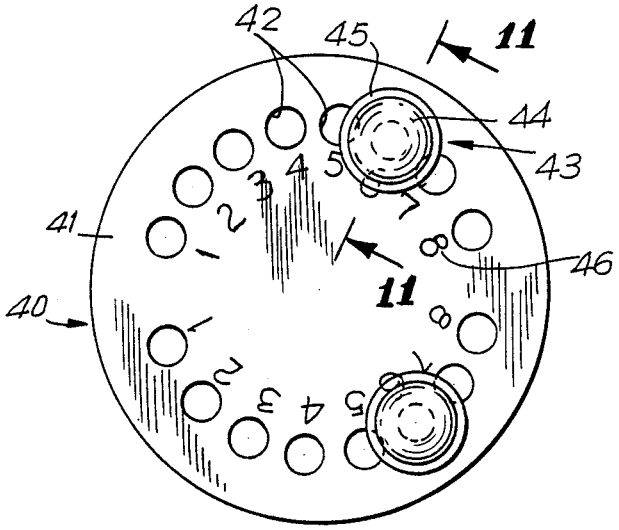
FIG. 10 illustrates the tennis scoring device embodied in a tennis ball cap showing tennis score marker pegs.

Generally stated, this tennis scoring apparatus comprises of:

(a) a flexible material being formed with means for detachably attaching at least two scoring placards to one side of said material and being formed with at least one set of eight pockets in line with and adjacent to the length of each of said scoring placards;

(b) at least two scoring placards bearing scoring indicia for a tennis match said scoring indicia being disposed on said placard so that each individual scoring indicia is adjacent to one of said pockets formed on said flexible material and an area for players names to be affixed to said placards;

(c) a set indicator marker removably insertable into said pockets formed on said flexible material;

(d) a game indicator marker of a different shape than said set indicator marker removably insertable into said pockets formed on said flexible material; and (e) means for attaching said tennis scoring apparatus to a support structure whereby said set and game indicator markers may be inserted into said pockets formed on said tennis scoring apparatus so as to correspond to and record the set and game score of said tennis match.

More specifically, this invention comprises a tennis scoring apparatus which is foldable so as to be configured into a portable configuration. It is preferred that this tennis scoring apparatus be constructed of a durable natural or synthetic woven fabric, such as nylon, enabling it to be subjected to folding and unfolding, a variety of environmental conditions and constant handling. It is also preferred that the tennis scoring apparatus be substantially rectangular or square in shape although it is foreseeable and within the scope o this invention that one may use other shapes. In the operation of this device, three scoring or indicator markers may be utilized in conjunction with scoring indicia which have been marked on placards which also comprise a portion of the device.

In the operation of this device, it is preferred that there are three types of tennis scoring or indicator markers: a large white marker having a paddle type shape, a smaller yellow colored paddle marker and a red colored paddle marker preferably the size of the yellow colored marker. It is to be understood that while these are the preferred embodiments of the tennis set and game indicator markers, they are merely illustrative and any color or size or shape of the paddle head may be utilized so long as there are at least three different configurations of indicator marker enabling them to be distinguishable from one another for their desired marking purpose. It is also preferred that at least two of each indicator marker be present with this apparatus so they may be used in conjunction with the preferably at least two tennis scoring placards utilized on the apparatus.

More specifically, the tennis scoring apparatus of this invention comprises a tennis scoring apparatus 10 shown in a folded and portable configuration in FIG. 1. The tennis scoring apparatus may be retained in this folded configuration by a belt 12 which is affixed with a buckle 11. It is preferred that this belt be of a rubber type material. However, any type of material in the form of a belt would be sufficient if it has adequate strength to hold the tennis scoring apparatus 10 in the appropriate folded configuration and later be utilized to attach said apparatus to a tennis netting post, the netting itself or a fence. The tennis scoring apparatus is shown in FIG. 2 affixed by lashing to a tennis netting post 14. The tennis netting post 14 is utilized to support tennis net 15 on a tennis court 16. Tennis scoring apparatus 10 can be seen in a reverse view in FIG. 2*a* to be affixed by a belt 12, preferrably including a belt buckle means for affixing it to the post, and if desired an additional belt 13 to the tennis netting post 14

In an alternative preferred embodiment, the tennis scoring apparatus 10 is shown to be affixed by rings 18 and lashing or strap material 19 to a fence 17. In the practice of this embodiment, the tennis scoring apparatus may be placed adjacent to the tennis court 16 by lashing it Onto a fence 17 which is in a convenient and/or visible location in relation to the tennis court if the players do not desire to directly affix the tennis scoring apparatus to a tennis netting post 14 or the tennis net 15.

The tennis scoring apparatus is shown in greater detail in FIG. 4. The tennis scoring apparatus 10 shown with a front view in FIG. 4 and includes the game and set indicator markers shown inserted into the pockets formed on said apparatus. The view provided by FIG. 4 is also that which would be seen by players and spectators during a tennis match. The material 20 which provides the structural support for this apparatus is shown in FIG. 4. It is this material onto which is formed the pockets 26 for insertion of scoring markers 24 and 25. Also supported on this material 20 are placards 22 and 23 which include not only the name (or names if doubles is being played) of the payer 36 but scoring indicia 35.

With the use of this apparatus, a respective player's game score and set tally is indicated directly under the placard 22 or 23 with his name on it by placing a game and/or set indicator marker 24 or 25 in pocket 26 directly under the appropriate game or set score. The indicia 35 indicates with the smaller indicator marker 25 the number of games which the player has won. The larger indicator marker 24 indicates the number of sets which the player has won. The set and game markers are inserted into pockets 26 formed by a material running across fabric 20 sewn at location 34 so as to form a pocket 26. This flexible material is also affixed to the tennis scoring apparatus with material 21 at location 27 which forms preferably the left and right border of said tennis scoring apparatus. It should also be noted that the name and scoring indicia placards may be reversed, in addition to indicating games add sets, so as to be utilized to indicate points scored in individual games. It is preferred to affix placards 22, 23 and 28 to said tennis scoring apparatus with a velcro attachment means 31 as shown in FIG. 7 and in FIG. 4.

Placard 37 on FIG. 4 also optionally displays non-scoring information such as promotional, organizational or sponsorship information or tennis rule information, thereby providing spectators with information concerning the nature of the tennis match (i.e., which high school or college teams are competing or professional or commercial sponsorship). In addition, it should be noted that placards 22, 23 and 28 are affixed and supported on said tennis scoring apparatus by stitching 29 which is adjacent to the top and bottom of the placards and provides support for them along the edges of said tennis scoring apparatus. This enables the placards to be slidably removed from said tennis scoring apparatus so as to facilitate writing of the names or other information onto said placard or so as to invert said placards to utilize, for instance, individual game scoring information (i.e., points 15, 30, 40 add) on the reverse side of the placard.

It is preferred in the practice of this invention that the tennis scoring markers be placed under the number indicia 35 on said tennis scoring apparatus and under the name of said player 36 so as to facilitate ease of determining scoring statistics particularly with regard to spectators sitting at a distance from said tennis match or so the players may easily determine their relative score in terms of games and sets of the tennis match. However, it is also foreseeable and within the scope of the invention that the game scoring placards be aligned in a vertical position or that said placards be adjacent to one another with said scoring marker indicia be located both above the top placard and below the bottom placard.

FIG. 5 shows the game scoring apparatus of FIG. 4 along cross-sectional line 5. In this view, the set scoring and game scoring or indicator markers can clearly be seen disposed within a pocket 26. It can also be seen that in the pocket adjacent to the location of said set and game marker is an empty pocket 26 wherein no game scoring or set marker has been placed. In addition, in FIG. 5, it can be seen that the support 30 demonstrates the means by which fabric 20 has been affixed at location 27 to side border material 21.

FIG. 6 shows the cross-sectional view of placard 23 illustrating cross-sectional view of placard 33 adjacent to material 20 and the relationship between material 20 and support material 21 with placard 23.

FIG. 7 as noted above illustrates the velcro attachment 31 attached to material 20 and the reverse side of placard 33 thereby enabling material 32 to be placed slidably or insertable between said placards 33 and 28. In this embodiment it is preferred that placard 28 be clear so that material disposed behind it and in between said placard 28 and placard 33 be visible to spectators or players through placard 28.

FIG. 8 illustrates a cross-sectional view along line 8—8 in FIG. 4. This figure illustrates game scoring marker 25 disposed within a pocket support 26. It should also be noted that the distance between said pocket stitching supports 34 should be such so that the placement of a game or set indicator marker 24 or 25 should correspond with and be below or adjacent to the game and/or set scoring indicia 35 on said placards 22 or 23. In order to do this effectively and so as to prevent said game or set indicator markers 24 or 25 from falling through said pockets, it is preferred that the diameter of the game marker at one end be wider than the positioning between the stitching support 34 which forms pocket 26. In this fashion, the smaller end of the game and set scoring markers 24 and 25 can be removably inserted into said pocket 26 with the larger end preventing it from falling through said pocket. In addition on FIG. 8, placard 28 is shown further comprising the clear placard 28 material, i.e. promotional material or sponsorship material 32 and an additional placard support 33. In addition, on FIG. 8 material 20 is shown to underlie all of the above components of the apparatus. It should also be noted that it is preferred that the game or set scoring indicator markers be removed from said tennis scoring apparatus prior to folding it into its portable configuration.

FIGS. 12–17 illustrate the operation and use of the tennis scoring device during a tennis match. These figures and the scores represented on them are briefly described below.

Figure 17:
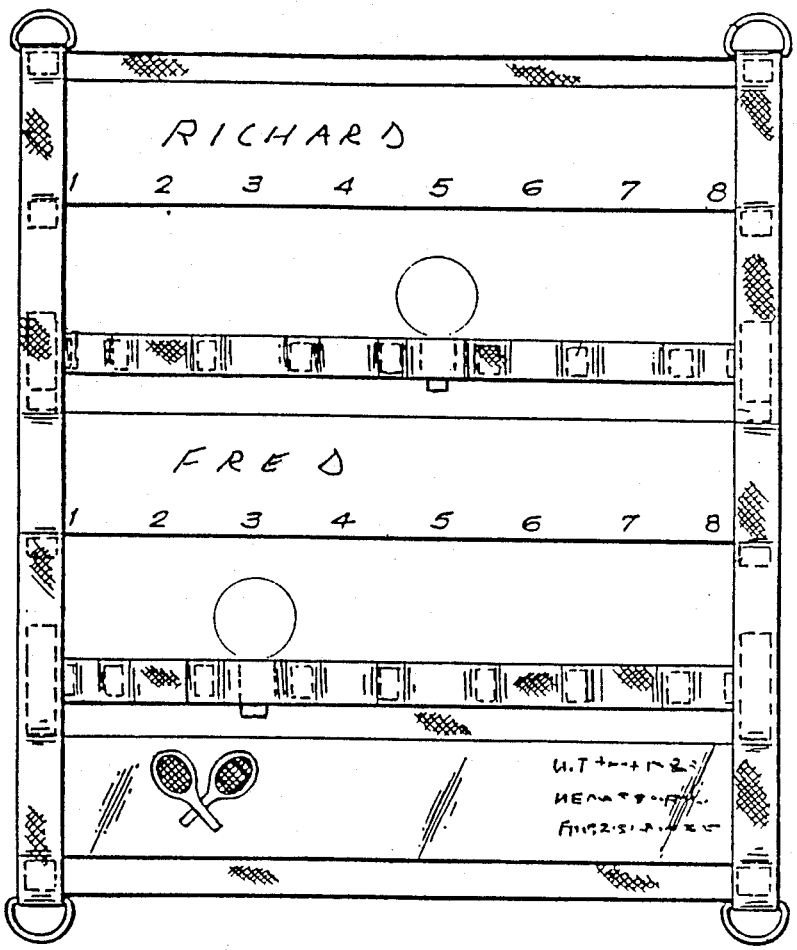
FIG. 17 illustrates the tennis scoring device in use scoring a tennis match.

In FIG. 17 Richard is shown leading 5 games to 3.

Figure 16:
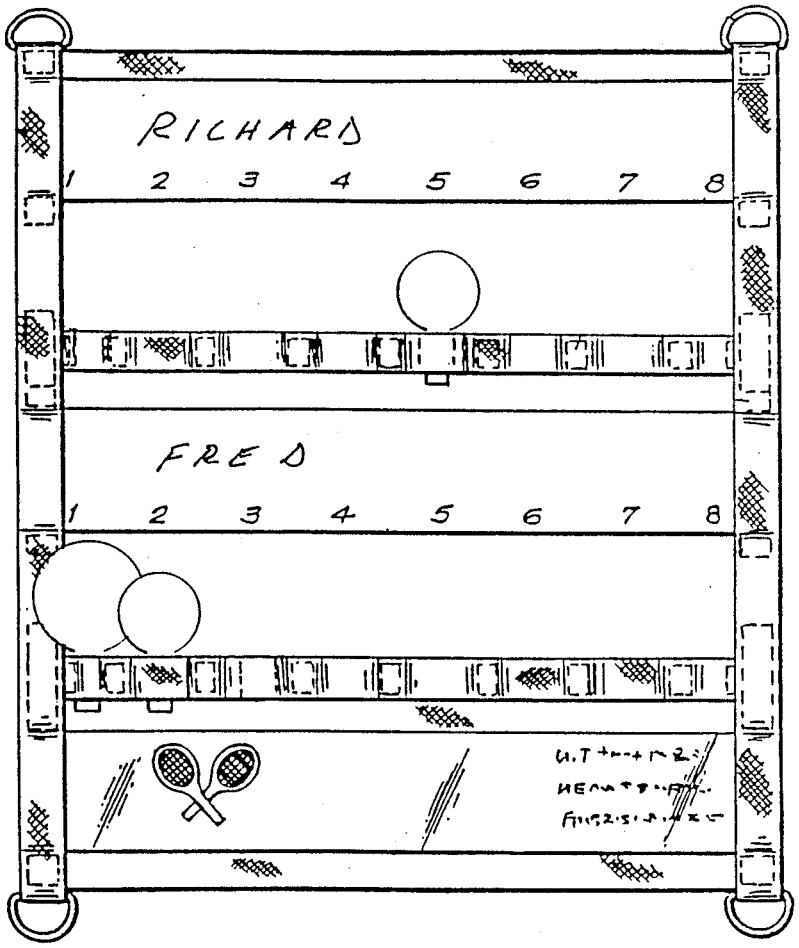
FIG. 16 illustrates the tennis scoring device in use scoring a tennis match.

In FIG. 16 Fred is shown to have won the first set. Richard is leading in the second set by 5 games to 2.

Figure 15:
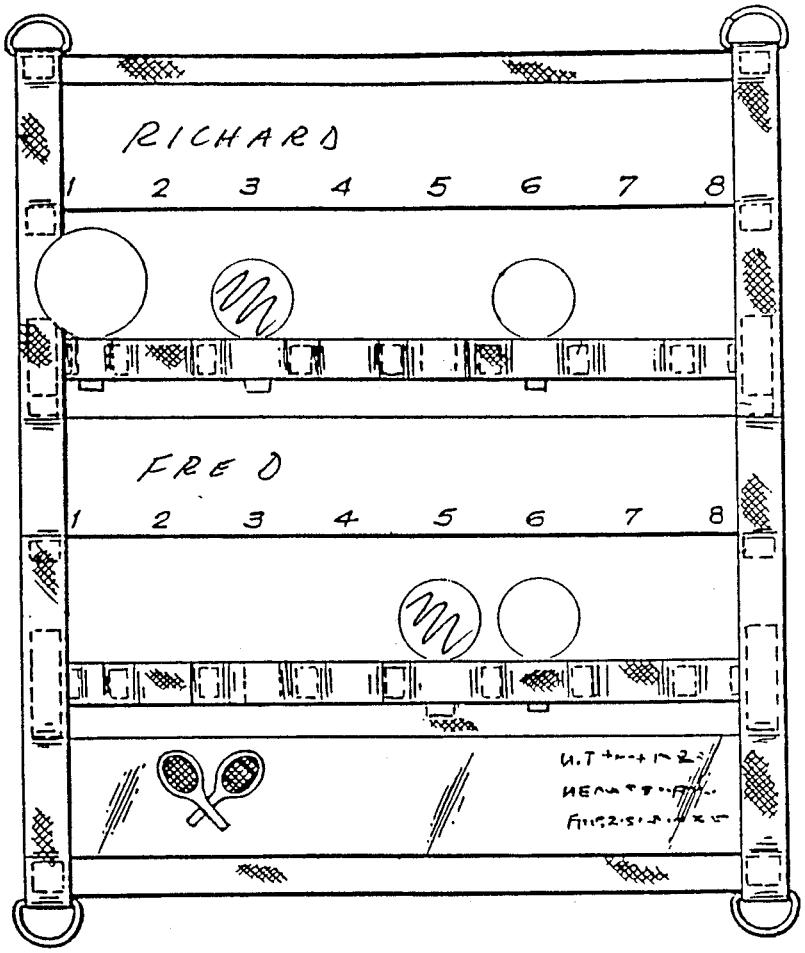
FIG. 15 illustrates the tennis scoring device in use scoring a tennis match.

In FIG. 15 Richard is shown to have won the first set. The score is six games all in the second set. Fred leads 5 points to 3 in the tie-break.

Figure 14:
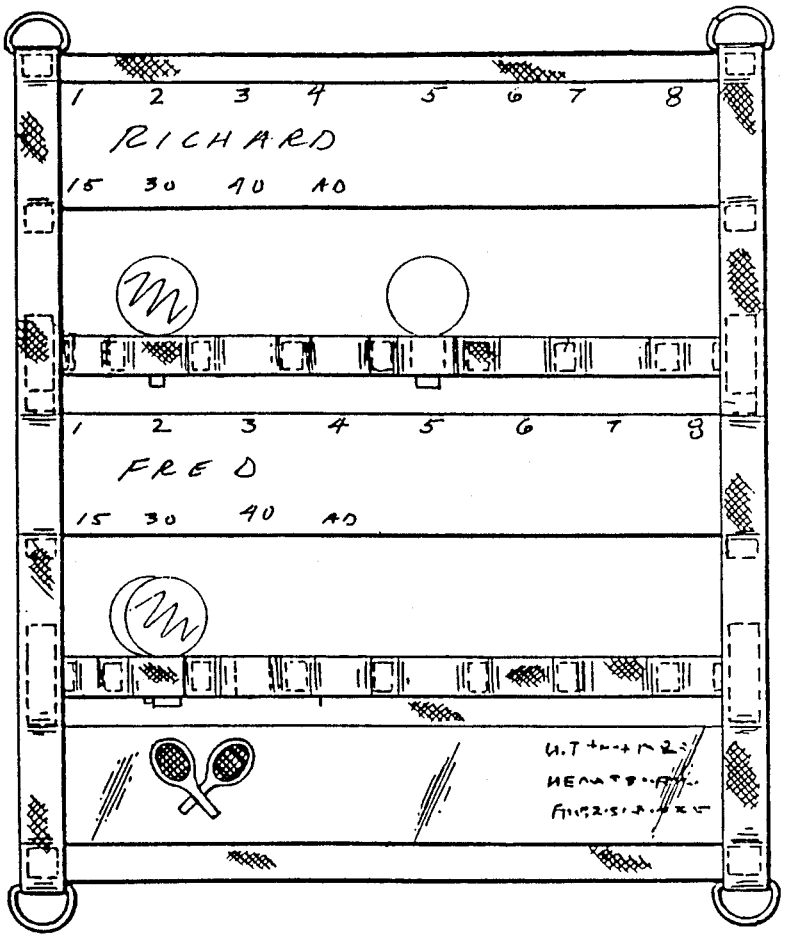
FIG. 14 illustrates the tennis scoring device in use scoring a tennis match.

In FIG. 14 (using Optional game point indicator, reverse side of placard) Richard is shown to lead 5 games to 2, and game points are 30 all.

Figure 13:
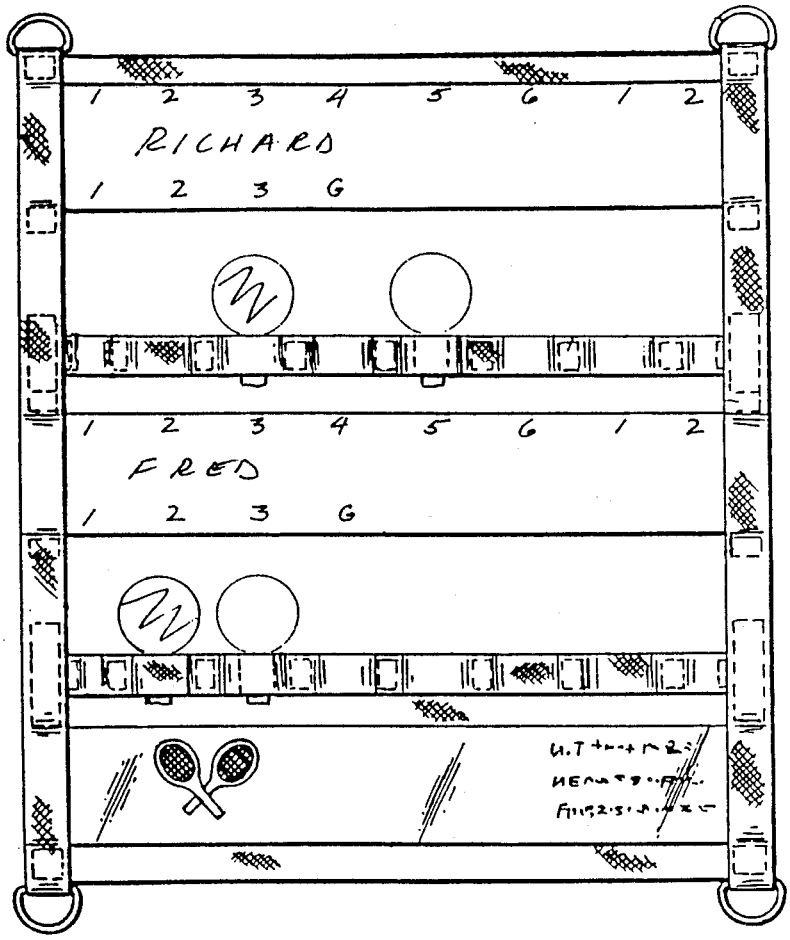
FIG. 13 illustrates the tennis scoring device in use scoring a tennis match.

In FIG. 13 (using Optional no-add indicator, reverse of placard) Richard leads in games 5 to 3, and he leads in points 3 to 2.

Figure 12:
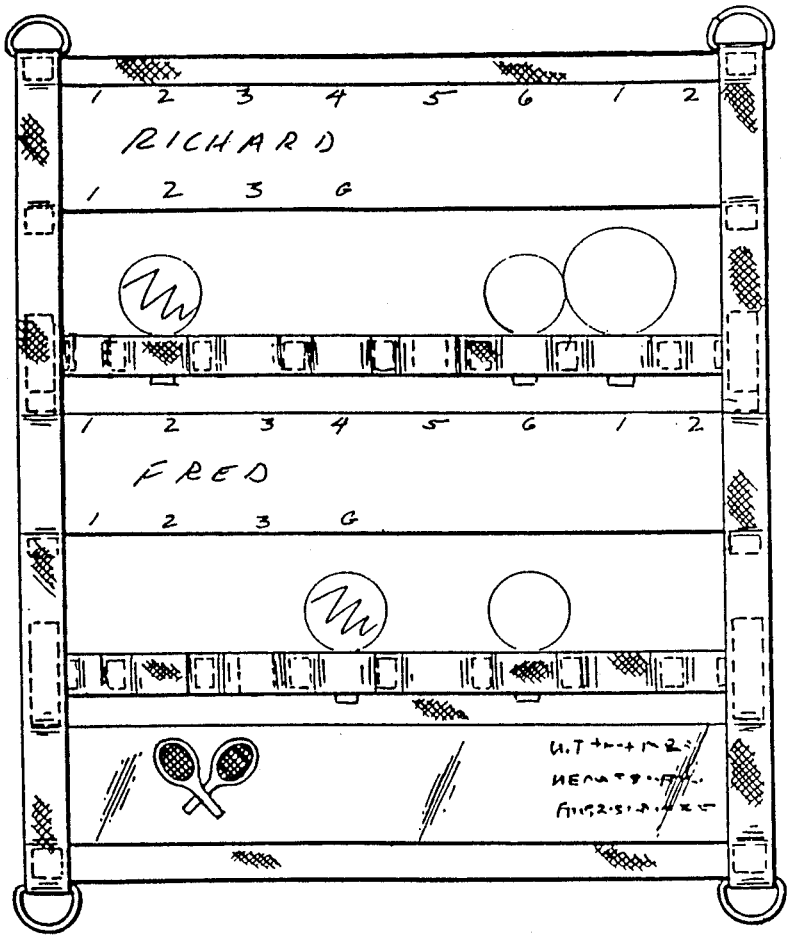
FIG. 12 illustrates the tennis scoring device in use scoring a tennis match.

In FIG. 12 (using Optional no-add indicator, reverse of placard) Richard has won the first set, games are 6-all, and Fred leads 4 to 2 in tie break points.

Another tennis scoring apparatus embodiment comprises a circular disk having 16 holes traversing the circumference of said disk and a plurality of pegs removably insertable within said holes, said 16 holes being in two sets of 8 holes with each hole being marked with indicia from 1 through 8 and a peg for removably inserting said pegs within said holes whereby the score of a tennis match in sets or games can be kept by disposably inserting said peg through said indicia labelled holes to indicate the number of sets or games won during said match by each player.

Figure 11:
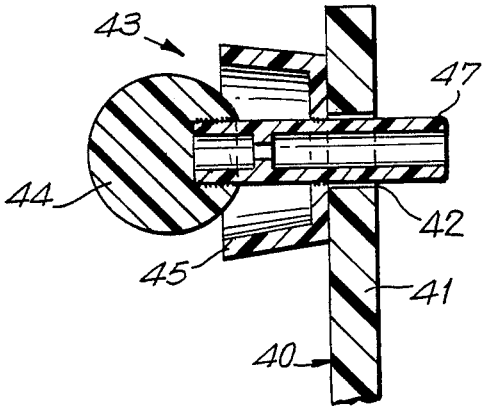
FIG. 11 illustrates a cross-sectional view of the tennis scoring device of FIG. 10 showing the tennis score game marker peg and said indicator.

More specifically, FIGS. 10 and 11 demonstrates this alternative embodiment of the tennis scoring apparatus 40. In this apparatus, the tennis scoring apparatus is comprised is of a circular disk type object which preferably comprises the top plastic cap on a tennis ball container (i.e., typically sold with three or more tennis balls stacked adjacent to one another within a cylindrical tube). e this embodiment, the tennis ball container cap 41 cover is provided with 2 sets of 8 holes 42. Each of the holes is labelled with indicia 46 ranging from the numbers 1 through 8. Each of these holes is used to represent either the number of games and/or sets won in a particular game by the players. The number of games and sets won by a particular player is indicated with game scoring marker peg 43. This game scoring marker 43 is comprised of peg 47 marker ball 44 and collar 45. The collar 45 is used as an indicator that the player has won a set. In use the peg and collar are moved from hole to hole as a single unit.

This apparatus is both small, convenient and also portable inasmuch as tennis players typically carry at least one container of tennis balls to any tennis game. Therefore, this invention enables a given tennis player to always have a scoring apparatus with him at a tennis match. In the preferred embodiment the sets and games won by either player may be scored. However, with an additional marker per player of a different color and/or configuration, it would be possible to also indicate both the number of sets and games won per player. It is also possible to indicate either by a scratch mark on the soft plastic cap 41 or with tape or other markings which of the 8 point scoring indicia represents a particular player. It is also possible that simply by virtue of the position of the cap on the tennis court or on the tennis can would be indicative that a particular set or game score represents a particular player.

Aspects of the present invention are not to be limited in scope by the preferred embodiments described herein, since these embodiments are intended as single illustrations. Indeed, various modifications of the invention in addition to those shown and described herein will become apparent to those skilled in the art from the foregoing description and accompanying drawings without having to depart from the spirit and scope of the invention.

I claim:

1. A tennis scoring apparatus comprising (a) a flexible material being formed with means for detachably attaching at least two scoring placards to one side of said material and being formed with at least one set of eight pockets in line with and adjacent to the length of each of said scoring placards;

(b) said at least two scoring placards bearing scoring indicia for a tennis match said scoring indicia being disposed on said placard so that each individual scoring indicia is adjacent to one of said pockets formed, on said flexible material and an area for a player's name to be affixed to each of said placards;

(c) a set indicator marker removably insertable into the pockets formed on said flexible material for visual registration with one of said scoring indicia;

(d) a game indicator marker of a different shape than said set indicator marker removably insertable into the pockets of said flexible material for visual registration with one of said scoring indicia, and (e) means for attaching said tennis scoring apparatus to a support structure whereby said set and game indicator markers may be inserted into said pockets formed on said tennis scoring apparatus so as to correspond to and record the set and game score of said tennis match.

2. The tennis scoring apparatus of claim 1 wherein the game indicator marker is paddle shaped.

3. The tennis scoring apparatus of claim 1 wherein said set indicator marker is paddle shaped.

4. The tennis scoring apparatus of claims 2 and 3 wherein said set indicator marker is larger than said game scoring marker.

5. The tennis scoring apparatus of claim 1 wherein said set and game indicator markers are different colors.

6. The tennis scoring apparatus of claim 5 wherein the color said game indicator markers is selected from the colors yellow and red.

7. The tennis scoring apparatus of claim 1 wherein said set indicator marker is white.

8. The tennis scoring apparatus of claim 1 further comprising a clear placard said placard including space for indicating non-scoring information.

9. The tennis scoring apparatus of claim 1 wherein said one end of said game and set indicator markers is disposably inserted into pockets formed on said tennis scoring apparatus.

10. The tennis scoring apparatus of claim 1 wherein said tennis scoring apparatus may be affixed by lashing it to said support structure.

11. The tennis scoring apparatus of claim 1 wherein said indicia and name including placards are affixed to said flexible material by hook and loop type fasteners.

12. The tennis scoring apparatus of claim 1 wherein said apparatus may be foldable about itself into a portable configuration.

13. The tennis scoring apparatus of claim 1 wherein said flexible material is selected from the group consisting of natural and synthetic woven material.

14. The tennis scoring apparatus of claim 13 wherein said material is nylon fabric.

15. The tennis scoring apparatus of claim 1 wherein said pockets are formed on said material by affixing a second strip of flexible material across a surface of said tennis scoring apparatus in a manner which forms said pockets between means provided for affixing said second strip of flexible material.

16. The tennis scoring apparatus of claim 1 wherein said scoring placards are formed of plastic.

17. The tennis scoring apparatus of claim 8 wherein said placard is formed of plastic.

18. The tennis scoring apparatus of claim 1 wherein said apparatus is substantially rectangular in shape.

19. The tennis scoring apparatus of claim 1 wherein said apparatus is substantially square in shape.

20. The tennis scoring apparatus of claim 18 and 19 wherein said means for attaching said tennis scoring apparatus to a support structure comprises rings attached to at least two corners of said apparatus and lashings for affixing said rings to a support structure.

21. The tennis scoring apparatus of claim 1 wherein said placards are 18 inches in length.

* * * * *